United States Patent [19]

Kume et al.

[11] Patent Number: 5,056,308

[45] Date of Patent: Oct. 15, 1991

[54] SYSTEM FOR FEEDBACK-CONTROLLING THE AIR-FUEL RATIO OF AN AIR-FUEL MIXTURE TO BE SUPPLIED TO AN INTERNAL COMBUSTION ENGINE

[75] Inventors: Tateo Kume; Michiyasu Yoshida; Yoshiaki Kodama, all of Kyoto; Kazuo Koga, Otokuni, all of Japan

[73] Assignee: Mitsubishi Jidosha Kogyo Kabushiki Kaisha, Tokyo, Japan

[21] Appl. No.: 470,135

[22] Filed: Jan. 25, 1990

[30] Foreign Application Priority Data

Jan. 27, 1989 [JP] Japan ..... 1-16288

[51] Int. Cl.[5] ..... F01N 3/20

[52] U.S. Cl. ..... 60/276; 60/285; 123/443

[58] Field of Search ..... 60/276, 285; 123/440, 123/443, 489

[56] References Cited

U.S. PATENT DOCUMENTS 4,227,496 10/1980 Martel ..... 123/443
4,409,949 10/1983 Tanaka ..... 123/443
4,467,602 8/1984 Iizuka ..... 60/276
4,793,135 12/1988 Obstfelder ..... 123/443
4,817,384 4/1989 Okumura ..... 60/276
4,912,926 4/1990 Kumagai et al. ..... 60/276

*Primary Examiner*—Douglas Hart
*Attorney, Agent, or Firm*—Frishauf, Holtz, Goodman & Woodward

[57] ABSTRACT

A feedback control system for an air-fuel ratio according to the present invention comprises a first oxygen sensor for detecting the oxygen concentration of exhaust gas flowing through a first exhaust pipe of an internal combustion engine, a second oxygen sensor for detecting the oxygen concentration of the exhaust gas passed through an exhaust gas disposer in a common exhaust passage which is connected with both first and second exhaust pipes of the engine, and an electronic control unit for calculating the amount of fuel supply to each cylinder of the engine in accordance with the oxygen concentration of the exhaust gas detected by means of the first oxygen sensor. The electronic control unit contains therein a correction circuit for correcting the amount of fuel supply to that cylinder of the engine which is associated with the second exhaust pipe, in accordance with the oxygen concentration of the exhaust gas detected by means of the second oxygen sensor.

18 Claims, 10 Drawing Sheets

SYSTEM FOR FEEDBACK-CONTROLLING THE AIR-FUEL RATIO OF AN AIR-FUEL MIXTURE TO BE SUPPLIED TO AN INTERNAL COMBUSTION ENGINE

BACKGROUND OF THE INVENTION

1. Field of the Invention

The present invention relates to a system for feedback-controlling the air-fuel ratio of an air-fuel mixture to be supplied to an internal combustion engine in which a plurality of cylinders are classified into two groups, to which exhaust passages are assigned individually.

2. Description of the Related Art

In an internal combustion engine to which the feedback control system of this type is applied, cylinders of two groups are separately connected to first and second exhaust passages which are independent of each other. The first and second exhaust passages open to the atmosphere through a common exhaust passage. An exhaust gas purifier or catalytic converter, which contains a three way catalyst, is disposed in the middle of the common exhaust passage.

The feedback control system, which is intended to control the air-fuel ratio of an air-fuel mixture to be supplied to the engine, comprises a first oxygen sensor for detecting the oxygen concentrations of exhaust gas discharged into the first and second exhaust passages, and a second oxygen sensor located on the lower-course side of the catalytic converter, in the common exhaust passage, and adapted to detect the oxygen concentration of the exhaust gas purified by the converter. Thus, according to the feedback control system provided with the first and second oxygen sensors, the amount of fuel to be supplied to each cylinder of the internal combustion engine, that is, the air-fuel ratio of the air-fuel mixture, is controlled in accordance with the oxygen concentrations of the exhaust gas detected by means of the first and second oxygen sensors. In this manner, the exhaust gas purifying efficiency of the catalytic converter can be improved.

In the feedback control system described above, the first oxygen sensor is generally disposed in the common exhaust passage on the upper-course side of the catalytic converter for efficaciously detecting the oxygen concentration of the exhaust gas flowing through the first and second exhaust passages by means of the first oxygen sensor.

In order to improve the exhaust gas purifying efficiency of the catalytic converter by means of the first and second oxygen sensors, it is necessary first to prevent a response delay of the first oxygen sensor and reduce the so-called limit cycle of feedback control. The response delay of the first oxygen sensor is caused, since the exhaust gas discharged from the engine takes much time to actually reach the first oxygen sensor after passing through the first and second exhaust passages and the common exhaust passage. Therefore, the response delay of the first oxygen sensor can be eliminated by disposing the first oxygen sensor in the exhaust passage so as to be situated as close to the engine as possible. However, since the exhaust passage of the engine includes the first and second exhaust passages separate from each other, as mentioned before, the first oxygen sensor must be disposed in only one of these two exhaust passages so as to be situated close to the engine. In this case, the first oxygen sensor can detect only the oxygen concentration of the exhaust gas discharged from the engine into the one exhaust passage. Accordingly, the amount of fuel to ber supplied to that group of cylinders connected to the other exhaust passage, that is, the air-fuel ratio of the air-fuel mixture for the cylinder group, cannot be feedback-controlled with high accuracy. Thus, the catalytic converter cannot enjoy a high purifying efficiency.

The first oxygen sensor may be disposed in each of the first and second exhaust passages so as to be situated close to the engine. This arrangement, however, requires an additional first oxygen sensor, thus entailing complicated feedback control, as well as increased costs of the feedback control system.

These problems associated with the arrangement of the first oxygen sensor are particularly noticeable when the feedback control system is applied to a V-type multicylinder internal combustion engine in which the first and second exhaust passages must inevitably be long.

SUMMARY OF THE INVENTION

The object of the present invention is to provide a feedback control system for an air-fuel ratio in an internal combustion engine, which, effectively using a second oxygen sensor, requires use of only one first oxygen sensor, and can secure a high degree of freedom, with respect to the arrangement of the first oxygen sensor, and improved the purifying efficiency of an exhaust gas purifier.

The above object is achieved by a feedback control system for an air-fuel ratio according to the present invention, which is applicable to an internal combustion engine including a plurality of cylinders classified into first and second groups, first and second exhaust pipes for guiding exhaust gas from the cylinders of the corresponding group connected to thereof, a common exhaust pipe connected with both the first and second exhaust pipes, a catalyst-type exhaust gas disposer located in the common exhaust pipe and used to purify the exhaust gas from the engine guided through the first and second exhaust pipes, and first and second fuel supply means assigned to the first and second groups of cylinders, respectively, and adapted to supply a fuel independently to the cylinders of the corresponding groups. The system comprises first detecting means for detecting the oxygen concentration of the exhaust gas flowing through the first exhaust pipe, second detecting means for detecting the oxygen concentration of the exhaust gas after being purified by means of the exhaust gas disposer, decision means for determinating the amount of fuel supplied from the first and second fuel supply means to the first and second groups of cylinders, in accordance with the oxygen concentration of the exhaust gas detected by the first detecting means, and correction means for correcting the amount of fuel supply from the second fuel supply means determined by the decision means, in accordance with the oxygen concentration of the exhaust gas detected by the second detecting means.

According to the feedback control system of the present invention, the first detecting means is expected only to detect the oxygen concentration of the exhaust gas in the first exhaust pipe, so that the first detecting means or a first oxygen sensor can be located in any desired position in the first exhaust pipe. Since the amount of fuel to be supplied to the second group of cylinders is corrected in accordance with the oxygen concentration of the exhaust gas detected by the second detecting means, the amount of fuel supply to the individual cylinders of the first and second groups, that is, the air-fuel ratio of an air-fuel mixture, can be optimally controlled. Since the first oxygen sensor in the first exhaust pipe can be situated as close to the engine as possible, moreover, it never has a bad influence upon a limit cycle in feedback control. Thus, the purifying efficiency of the exhaust gas disposer can be considerably improved.

The above and other objects, features, and advantages of the invention will be more apparent from the ensuing detailed description taken in connection with the accompanying drawings.

DETAILED DESCRIPTION

Figure 1:
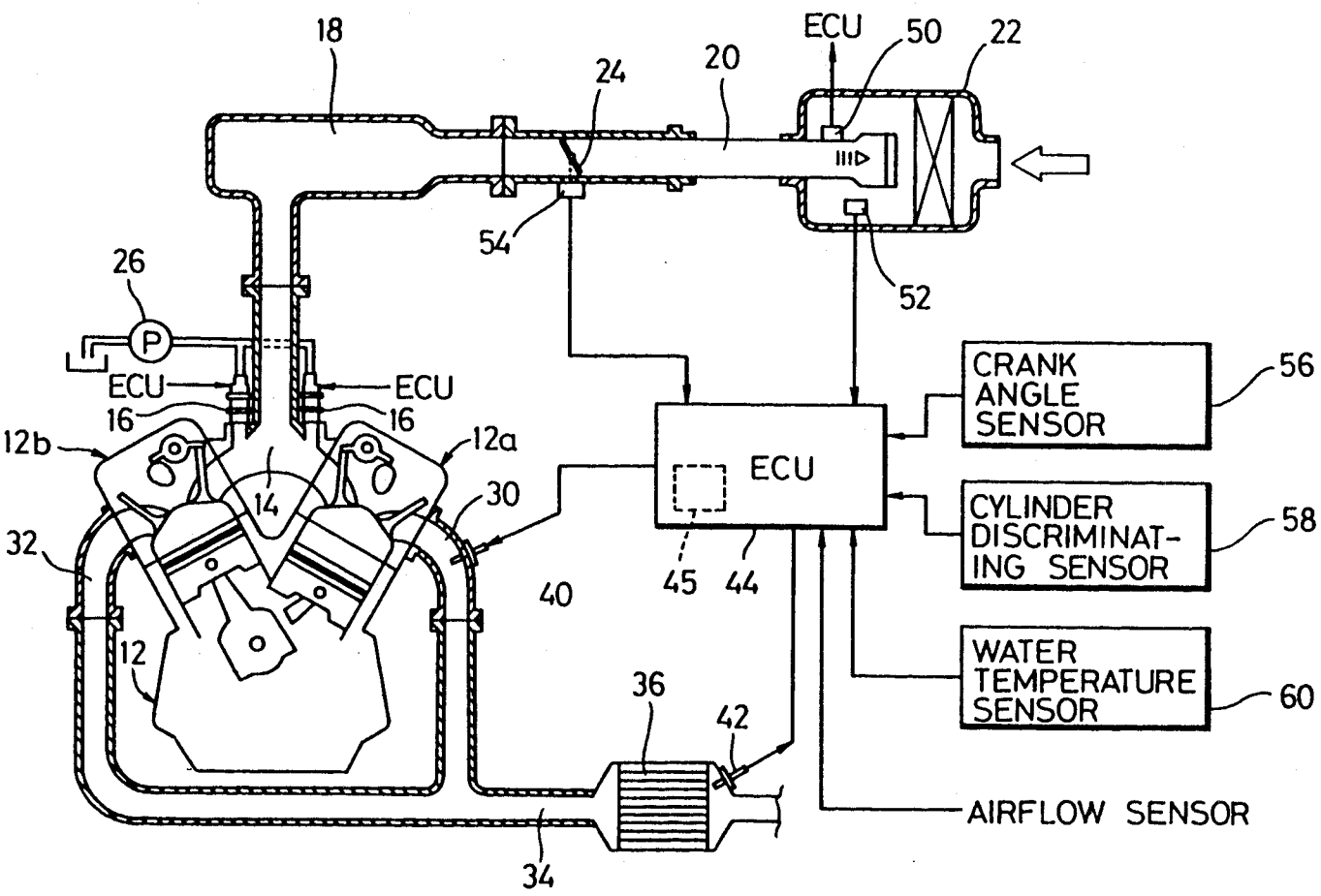
FIG. 1 is a block diagram showing a feedback control system according to one embodiment of the present invention, along with part of an internal combustion engine.

Referring now to FIG. 1, there is shown part of an internal combustion engine 12 which incorporates a feedback control system according to the present invention. The internal combustion engine 12 is a vehicular V-type 6-cylinder engine (hereinafter referred to as V-6 engine or simply as engine).

Engine 12 is divided into two parts, right and left banks 12*a* and 12*b*, and each bank is provided with three cylinders. More specifically, the right bank 12*a* has first, third, and fifth cylinders, while the left bank 12*b* has second, fourth, and sixth cylinders, for example.

Intake manifolds 14 are connected to individual cylinders of the right and left banks. Electromagnetic fuel injection valves 16 are arranged individually at those portions of the intake manifold 14 which are located close to the respective inlet ports of the cylinders. One end of an intake pipe 20 is connected to the intake manifold 14 through a surge tank 18, and the other end (open-air end) of the pipe 20 opens to the atmosphere through an air cleaner 22. A throttle valve 24 is disposed in the middle of the intake pipe 20. Each fuel injection valve 16 is supplied with a fuel from a fuel pump 26. The pressure of fuel is adjusted to a constant pressure by means of a fuel pressure regulator (not shown).

A right-bank-side exhaust manifold 30 is connected to each cylinder of the right bank 12*a* through an exhaust port of the cylinder. Likewise, left-bank-side exhaust manifold 32 is connected to each cylinder of the left bank 12*b* through an exhaust port of the cylinder.

Those end portions of the exhaust manifolds 30 and 32 remote from the engine are connected a common exhaust pipe 34. A catalytic converter 36 of the three way type is disposed in the middle of the common exhaust pipe 34. An oxygen sensor (hereinafter referred to as front $O_2$ sensor) 40 of the concentration-cell type for detecting the oxygen concentration of an exhaust gas is attached to one of the exhaust manifolds, e.g., the right-bank-side exhaust manifold 30. The front $O_2$ sensor 40 is situated as close to the engine as possible. In the exhaust manifold 30, for example, the front $O_2$ sensor 40 is located in a region where exhaust gas flows discharged from the individual cylinders meet one another. Also, an oxygen sensor (hereinafter referred to as rear $O_2$ sensor) 42 of the concentration-cell type is provided on the lower-course side of the catlytic converter 36, e.g., on the rear end portion of the converter 36. The rear $O_2$ sensor 42 serves to detect the residual oxygen concentration of the exhaust gas after having passed the catalytic converter 36. Each $O_2$ sensor contains a heater for keeping its detecting element at high temperature.

The $O_2$ sensors 40 and 42 are connected electrically to an electronic control unit (hereinafter referred to simply as ECU) 44. Signals corresponding to the oxygen concentration of the exhaust gas are supplied from the $O_2$ sensors 40 and 42 to the ECU 44.

Figure 2:
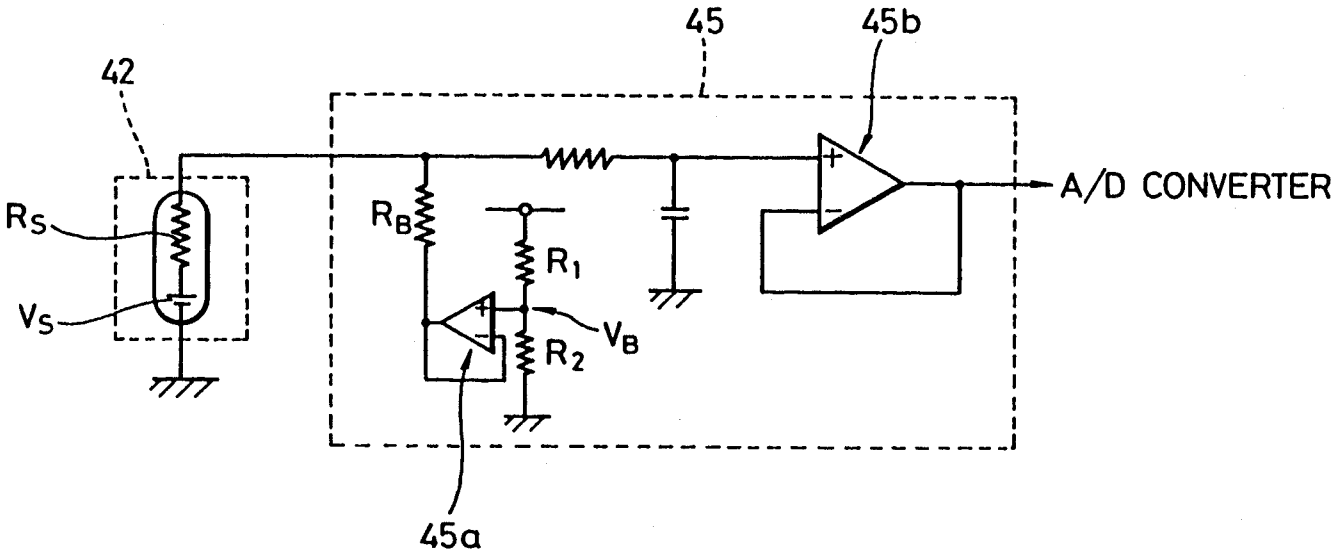
FIG. 2 shows a receiver circuit included in an electronic control unit shown in FIG. 1 and adapted to receive a signal from a rear $O_2$ sensor.

FIG. 2 shows a receiver circuit 45 which is contained in the ECU 44, and receives the signal from the rear $O_2$ sensor 42. The receiver circuit 45 includes a bias circuit 45*a* and an amplifier circuit 45*b*. The bias circuit 45*a* applies a predetermined bias voltage $V_B$ to an output voltage VR of the rear $O_2$ sensor 42. Thus, the bias circuit 45*a* is connected to the output end of the rear $O_2$ sensor 42 through a reference resistor $R_B$.

The rear $O_2$ sensor 42 may be regarded as an electric circuit, which includes an internal resistor $R_S$ and a power source $V_S$. The resistance of the internal resistor $R_S$ varies depending on whether the sensor 42 is active, while the output voltage of the power source $V_S$ varies depending on the oxygen concentration of the exhaust gas. The internal resistance $R_S$ is small when the rear $O_2$ sensor 42 is active, and is greater when the sensor 42 is not. The bias voltage $V_B$ of the bias circuit 45*a* is set to a reference voltage $V_{XR}$ between the upper-limit value (e.g., 1 V) and the lower-limit value (e.g., 0 V) of the output voltage $V_R$ of the rear $O_2$ sensor 42.

The resistance of the reference resistor $R_B$ is set to a value which is smaller enough than the value of the internal resistance $R_S$ obtained when the $O_2$ sensor 42 is inactive, and is greater enough than the value of the internal resistance obtained when the $O_2$ sensor 42 is active.

The output voltage $V_R$ of the rear $O_2$ sensor 42 is high when the oxygen concentration of the exhaust gas is low (or when an air-fuel mixture is rich), and is low when the oxygen concentration of the exhaust gas is high. If the rear $O_2$ sensor 42 detects the oxygen concentration of the exhaust gas when the air-fuel ratio of the air-fuel mixture is at a theoretical value, the output voltage $V_R$ of the sensor 42 is in the vicinity of the aforesaid reference voltage $V_{XR}$.

When the rear $O_2$ sensor 42 is not activated yet, therefore, the receiver circuit 45 produces a minimum voltage which is substantially equal to the reference voltage or bias voltage $V_B$ of the bias circuit 45*a*. If the air-fuel ratio of the air-fuel mixture is on the rich side when the rear $O_2$ sensor 42 is active, the receiver circuit 45 produces a maximum voltage $V_{RN}$ which is higher than the aforesaid minimum voltage. If the air-fuel ratio of the air-fuel mixture is on the lean side when the rear $O_2$ sensor 42 is active, on the other hand, the receiver circuit 45 produces a voltage which is intermediate between the minimum voltage and the maximum voltage $V_{RN}$. The output voltage VR from the receiver circuit 45 is supplied to an A/D converter.

As the output voltage $V_R$ of the rear $O_2$ sensor 42 is valiable, therefore, the voltage (instantaneous value) delivered from the receiver circuit 45 to the A/D converter is also both variable. A digital signal obtained as a result of conversion by the A/D converter is filtered. The resulting detection signal from the rear $O_2$ sensor 42 or the receiver circuit 45 is designated by $V_{R02}$.

A receiver circuit for the front $O_2$ sensor 40 may be constructed in the same manner as the receiver circuit 45 for the rear $O_2$ sensor 42, or may alternatively be a conventional circuit which includes no bias circuit.

The individual fuel injection valves 16, which are connected electrically to the output terminal of the ECU 44, are opened in response to a driving signal from the ECU 44, thereby allowing a required amount of fuel to be supplied to their corresponding cylinders.

Besides the front and rear $O_2$ sensors 40 and 42, various sensors for detecting the operating conditions of the engine 12 are connected to the input terminal of the ECU 44. These sensors include, for example, an airflow sensor 50, intake air temperature sensor 52, throttle opening sensor 54, crank angle sensor 56, cylinder discriminating sensor 58, water temperature sensor 60, etc. The airflow sensor 50, which is mounted on the intake pipe 20 near the other end thereof, delivers a generating frequency of Kalman vortexes proportional to the amount of intake air. The intake air temperature sensor 52, which is disposed in air cleaner 22, detects the temperature of the intake air and delivers a signal corresponding to this temperature. The throttle opening sensor 54 detects the opening of the throttle valve 24, and delivers a signal corresponding to the valve opening. The crank angle sensor 56, which is disposed in a distributor (not shown), delivers a pulse signal (TDC signal) every time a crank of the engine 12 reaches its top dead point or a rotational-angle position just ahead of it. The cylinder discriminating sensor 58, which is also disposed in the distributor, delivers a pulse signal every time a specific cylinder (e.g., first cylinder) reaches a predetermined crank-angle position (e.g., top dead point or the rolational-angle position. The water temperature sensor 60 detects the temperature of cooling water for the engine 12, and delivers a signal corresponding to this temperature.

Further, the ECU 44 is connected with an idle switch (not shown) used to detect the fully-closed position of the throttle valve 24, an atmospheric pressure sensor (not shown) for detecting atmospheric pressure, a battery sensor (not shown) for detecting the battery voltage of an automobile which carries the engine, and other sensors. If the automobile is equipped with an air conditioner, the ECU 44 is also connected with an air conditioner switch used to detect the operating conditions of the air conditioner.

In response to signals from the aforesaid various sensors, the ECU 44 calculates a fuel injection quantity suited for the operating conditions of the engine 12, that is, a valve-opening period $T_{INJ}$ of each fuel injection valve 16, and supplies a driving signal corresponding to the period $T_{INJ}$ to the valve 16. On receiving the driving signal, each fuel injection valve 16 is opened for the period $T_{INJ}$, so that a required amount of fuel is supplied to its corresponding cylinder.

The ECU 44 can detects the speed Ne of the engine 12 from the interval between the TDC signals delivered from the crank angle sensor 56. Since the ECU 44 is stored with the firing order of the cylinders, that is, the order of fuel supply to the individual cylinders, it can determine the proper cylinder to be supplied next with the fuel, on receiving the signal from the cylinder discriminating sensor 58.

Referring now to the flow charts of FIGS. 3 to 9, the sequence of calculation of the aforesaid valve-opening period $T_{INJ}$ executed by the ECU 44 will be described.

The ECU 44 includes first and second interruption routines and an arithmetic routine. The first interruption routine is executed with first priority every time the production of a Kalman vortex is detected by the airflow sensor 50. The second interruption routine is executed every time the TDC signal is delivered from the crank angle sensor 56. The arithmetic routine is repeatedly executed in predetermined cycles when neither of the first and second interruption routines are being executed. In the arithmetic routine, a correction factor is computed in determining the aforesaid valve-opening period $T_{INJ}$. Thus, the valve-opening period $T_{INJ}$ can be calculated by executing these routines.

First, the arithmetic routine shown in FIGS. 3 to 5 will be described.

The ECU 44 successively reads the signals from the aforementioned various sensors, and in Step S10, executes A/D conversion and other processing of the input signals, that is, input information processing. Input data processed in Step S10 include cooling water temperature $T_W$ for the engine 12 from the water temperature sensor 60, intake air temperature Ta from the intake air temperature sensor 52, atmospheric pressure Pa from the atmospheric pressure sensor, and the oxygen concentration of the exhaust gas from the front and rear $O_2$ sensors 40 and 42. The processed input data are stored in a memory in the ECU 44.

Subsequently, in Steps S12, S14, and S16, whether the engine 12 is ready for the feedback control of the air-fuel ratio is determined. In Step S12, whether a predetermined time t1 has elapsed after the start of the engine 12 is determined. If the decision in Step S12 is NO, then it indicates that the operating conditions of the engine 12 are not stabilized yet, so that the feedback control is not effected. In this case, the program proceeds from Step S12 to Step S40, whereupon a first correction factor $K_{AS}$, used to increase the amount of fuel supply, is given a value which is set corresponding to the time elapsed after the start of the engine 12.

If the decision in Step S12 is YES, on the other hand, the program proceeds to Step S13, whereupon 1.0 is given as the value for the first correction factor $K_{AS}$.

In Step S14, whether the cooling water temperature $T_W$, obtained according to the signal from the water temperature sensor 60, is higher than a predetermined value $T_{W1}$ is determined. In other words, whether the engine 12 is warm or cold is determined in Step S14. If the cooling water temperature $T_W$ is not higher than the predetermined value $T_{W1}$, that is, if the engine 12 is cold, the feedback control is not effected, the program proceeds from Step S14 to Step S42. In Step S42, a second correction factor $K_{WT}$, used to increase the amount of fuel supply, is given a value which is obtained in consideration of the cooling water temperature $T_W$, for example. In this case, the upper limit of the second correction factor $K_{WT}$ may be determined depending on the value of the first correction factor $K_{AS}$.

If the decision in Step S14 is YES, that is, if the cooling water temperature $T_W$ is higher than the predetermined value $T_{W1}$, the program proceeds to Step S15. In Step S15, 1.0 is given as the value for the second correction factor $K_{WT}$.

Subsequently, in Step S16, whether the engine 12 is operated within an operation area in which the air-fuel ratio can be feedback-controlled, that is, whether the engine 12 is within a normal operation area, even when it is neither in a state immediately after the start of operation nor in the cold state, is determined. This decision is made in accordance with the speed Ne and intake air amount A/N, for example. Other areas than the normal operation area include a WOT operation area in which the engine 12 is operated with the throttle valve 24 fully open, an accelerating operation area in which the engine 12 is operated with the throttle valve 24 quickly opened, and a decelerating operation area in which the engine 12 is operated at the speed Ne higher than a predetermined speed and with the idle switch on. If the decision in Step S16 is NO, the program proceeds to Step S44, whereupon a third correction factor $K_{AF}$, used to correct the air-fuel ratio, is given a value which is suited for the accelerating operation area, for example. In Step S44, moreover, 1.0 is given as the value for a fourth correction factor $K_{FB}$ which is used for the feedback control of the injection quantity of the fuel injection valve 16. Also, a correction variable $I_{LRN}$, used in correcting the air-fuel ratio by learning, is given an up-to-date value which is held in the nonvolatile memory (not shown) in the ECU 44. If the decision in Step S16 is YES, on the other hand, the program proceeds to Step S17, whereupon 1.0 is given as the value for the third correction factor $K_{AF}$.

Figure 4:
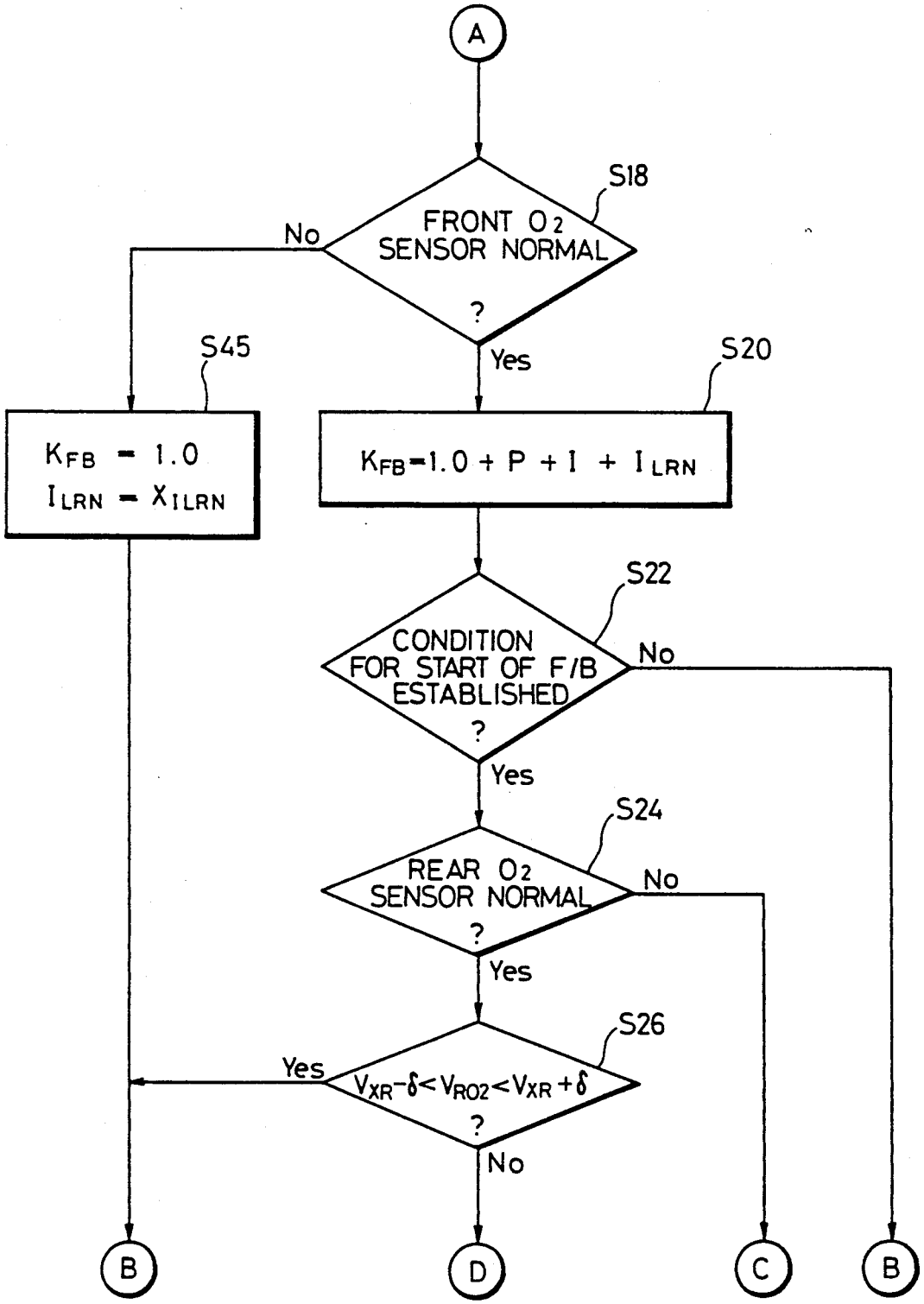
Figure 5:
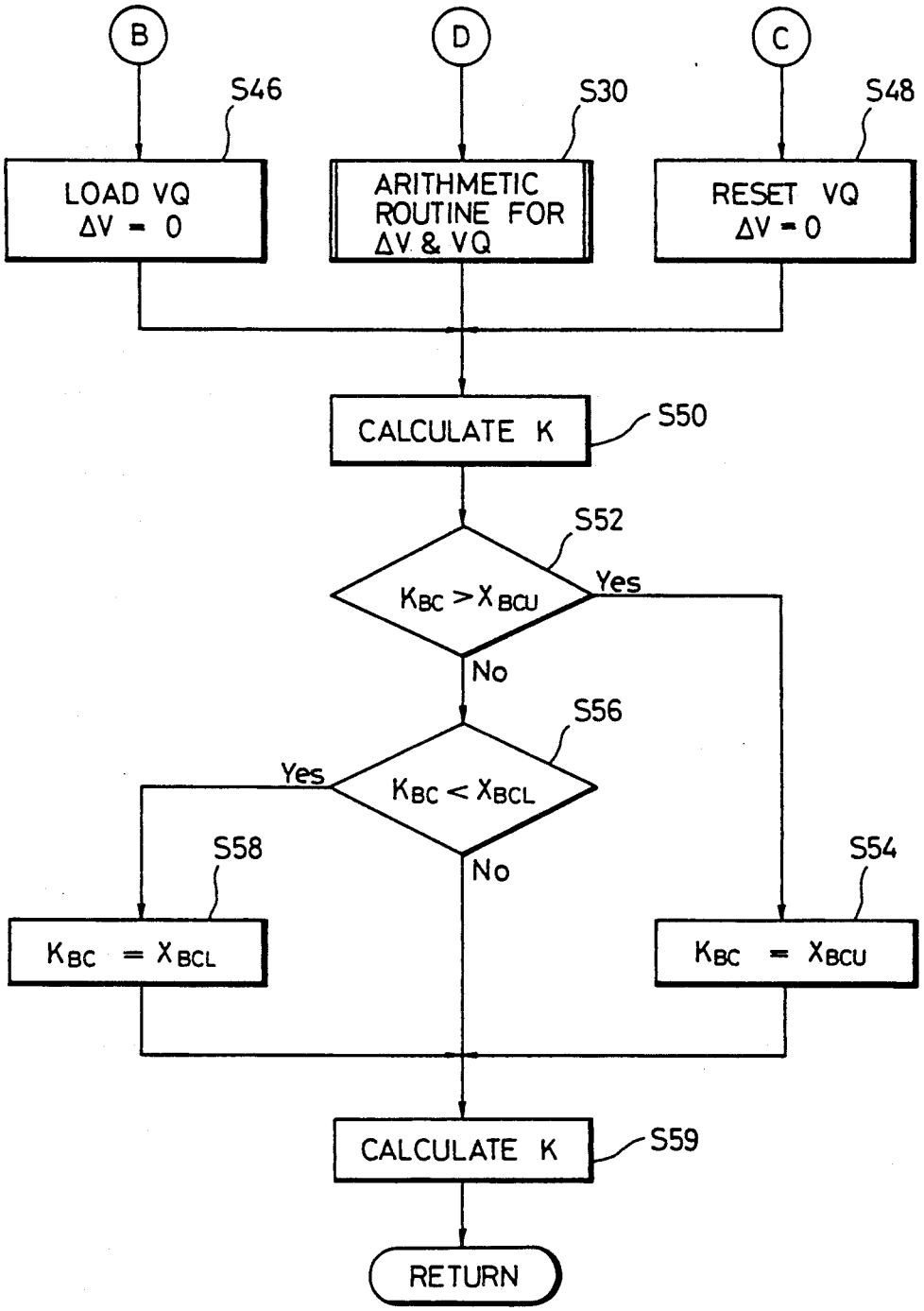

If it is concluded in Steps S12, S14, and S16 that the engine 12 is in a state such that the feedback control of the air-fuel ratio should not be executed, as described above, the first to forth correction factors and the correction variable are given predetermined values, and then the program proceeds to Step S46 shown in FIG. 5. If the engine 12 is in a state such that the feedback control of the air-fuel ratio can be executed, on the other hand, the program proceeds to Step S18 shown in FIG. 4.

In Step S18, whether the front $O_2$ sensor 40 is normal is determined. This conclusion includes a decision on whether the front $O_2$ sensor 40 is active, as well as an identification of trouble, such as disconnection. A failure of the front $O_2$ sensor 40 can be detected depending on whether the output voltage of the sensor 40 is kept at 0 V or at a predetermined value (e.g., 5 V) or higher for a predetermined period of time, respectively. It is concluded that the front $O_2$ sensor 40 is activated when the output voltage of the sensor 40 first attains a level not lower than a reference voltage $V_{XF}$ after the start of the engine 12, for example. It is concluded, on the other hand, that the sensor 40 is inactive when the output voltage of the sensor 40 is lower than the reference voltage $V_{XF}$ for a predetermined period of time (e.g., 20 seconds) during the feedback control.

If the decision in Step S18 is NO, the program proceeds to Step S45. In Step S45, the fourth correction factor $K_{FB}$ is set to 1.0, and the correction variable $I_{LRN}$ is set to a predetermined value $X_{ILRN}$ which is stored in the aforementioned memory, whereupon the program proceeds to Step S46 of FIG. 5.

If the decision in Step S18 is YES, on the other hand, the program proceeds to Step S20. In Step S20, the value of the fourth correction factor $K_{FB}$ is calculated according to the following equation, and the obtained value is stored in the aforesaid memory.

$$K_{FB}=1.0+P+I+I_{LRN} \quad (1)$$

where P and I are the values of a proportional term and an integral term, respectively, for the feedback control which are obtained by calculation based on the arithmetic routine for the values P and I for the fourth correction factor $K_{FB}$ (mentioned later), and are stored in the aforesaid memory.

Further, the correction variable $I_{LRN}$ is a value used to correct the air-fuel ratio by learning. The value $I_{LRN}$ is obtained from the time average of values for the integral term I obtained by learning in the ECU 44 when the engine 12 is operated in a predetermined operating condition such that the correction value $I_{LRN}$ may be updated, for example.

Then, the ECU 44 proceeds to Step S22, whereupon whether a condition to allow the feedback control to be actually started is established is determined. In order to obtain a positive decision in Step S22, the following requirements (1) to (3), as well as the aforementioned requirement that the engine should be in the normal operation area should be fulfilled.

REQUIREMENT (1)

The cumulative amount of intake air introduced into the engine 12 after the operating state of the engine 12 attains the normal operation area should not be less than a predetermined value Q1.

REQUIREMENT (2)

The cumulative amount of intake air introduced after the operation state of the engine 12 attains an operation area such that the fuel is cut off should not be less than a predetermined value Q2.

REQUIREMENT (3)

The generating frequency detected by means of the airflow sensor 50 should not be less than a predetermined value F1, that is, the amount of intake air introduced into the engine 12 per unit time should not be less than a predetermined value.

If any of these requirement is not fulfilled, the feedback control cannot be executed at once, and the conventional feedback control by means of the front $O_2$ sensor 40 only, that is, the feedback control for the air-fuel ratio by the use of one $O_2$ sensor, is executed. Thus, if the decision in Step S22 is NO, the the program proceeds from Step S22 to Step S46 shown in FIG. 5.

If the decision in Step S22 is YES, on the other hand, the program proceeds to Step S24, whereupon whether the rear $O_2$ sensor 42 is normal, that is, whether the sensor 42 is in trouble due to a short circuit or the like is detected. In this detection, it is concluded that the rear $O_2$ sensor 42 is in trouble when the output voltage of the sensor 42 is 0 V or higher than a predetermined upper-limit voltage (e.g., 1.5 V), for example. Since the receiver circuit 45 of the rear $O_2$ sensor 42 includes the bias circuit 45a, as shown in FIG. 2, the output voltage of the sensor 42 cannot be 0 V or higher than the upper-limit voltage (1.5 V) unless the sensor 42 is in trouble due to a short circuit. Thus, when the output voltage of the rear $O_2$ sensor 42 is 0 V, there is a short circuit such that the output side of the sensor 42 is grounded. If the output voltage of the sensor 42 is higher than the upper-limit voltage (1.5 V), it is concluded that the sensor 42 is in trouble such that it is short-circuited with the power supply.

If the rear $O_2$ sensor 42 is in trouble, that is, if the decision in Step S24 is NO, the program proceeds to Step S48 shown in FIG. 5. If the decision in Step S24 is YES, on the other hand, the program proceeds to Step S26. In Step S26, whether the output voltage $V_{RO2}$ from the rear $O_2$ sensor 42 is within an insensitive zone around the reference voltage $V_{XR}$ is determined.

If the rear $O_2$ sensor 42 in its normal state detects the oxygen concentration of the exhaust gas passed through the catalytic converter 36, that is, the ambient gas surrounding the sensor 42, when the air-fuel ratio of the air-fuel mixture is on the rich side, the output voltage $V_{RO2}$ of the sensor 42 is higher than the upper-limit value ($V_{XR}+\delta$) of the insensitive zone and lower than the aforesaid upper-limit value (1.5 V). On the other hand, if the rear $O_2$ sensor 42 in the normal state detects the oxygen concentration of the exhaust gas when the air-fuel ratio of the air-fuel mixture is on the lean side, the output voltage $V_{RO2}$ of the sensor 42 is lower than the lower-limit value ($V_{XR}-\delta$) of the insensitive zone and higher than 0 V. If the air-fuel ratio of the air-fuel mixture is nether on the rich side nor on the lean side, that is, if an optimum amount of fuel is supplied to the engine 12, the output voltage $V_{RO2}$ of the sensor 42 is within the insensitive zone ranging from ($V_{XR}-\delta$) to ($V_{XR}+\delta$).

When the rear $O_2$ sensor 42 is inactive, its output voltage $V_{RO2}$ is within the insensitive zone ranging from ($V_{XR}-\delta$) to ($V_{XR}+\delta$). Thus, when the sensor 42 is inactive or when an optimum amount of fuel is supplied to the engine 12, the decision in Step S26 is YES, and the program proceeds to Step S46 of FIG. 5. If the decision in Step S26 is NO, on the other hand, the program proceeds to Step S30.

In Steps S30, S46, and S48, a deviation $\Delta V$ and a deviation integral VQ are set individually. These values $\Delta V$ and VQ are used to calculate the fifth correction factor $K_{BC}$ for correcting the difference of the bank.

In executing open-loop control, in a case such that the engine 12 is not operated in the aforementioned normal operation area, for example, or feedback control of the air-fuel ratio by means of the front $O_2$ sensor 40 only, when the output voltage $V_{RO2}$ of the rear $O_2$ sensor 42 is within the insensitive zone ranging from ($V_{XR}-\delta$) to ($V_{XR}+\delta$), the process of Step S46 is executed so that the deviation $\Delta V$ is set to 0. The deviation integral VQ is set not to a value newly obtained by calculation, but to an up-to-date value which is already obtained by calculation in Step S33 (mentioned later) of FIG. 6 and stored in the aforesaid memory.

If it is concluded that the rear $O_2$ sensor 42 is in trouble, the process of Step S48 is executed. In Step S48, the deviation $\Delta V$ is set to 0, and the deviation integral VQ is set to an initial value stored in the memory.

If both the front and rear $O_2$ sensors 40 and 42 are normal and the output voltage $V_{RO2}$ of the rear $O_2$ sensor 42 is not within the insensitive zone ranging from ($V_{XR}-\delta$) to ($V_{XR}+\delta$), when the engine 12 is operated within the normal operation area, the process of Step S30 is executed. In Step S30, an arithmetic routine for obtaining the values $\Delta V$ and VQ is started.

Figure 6:
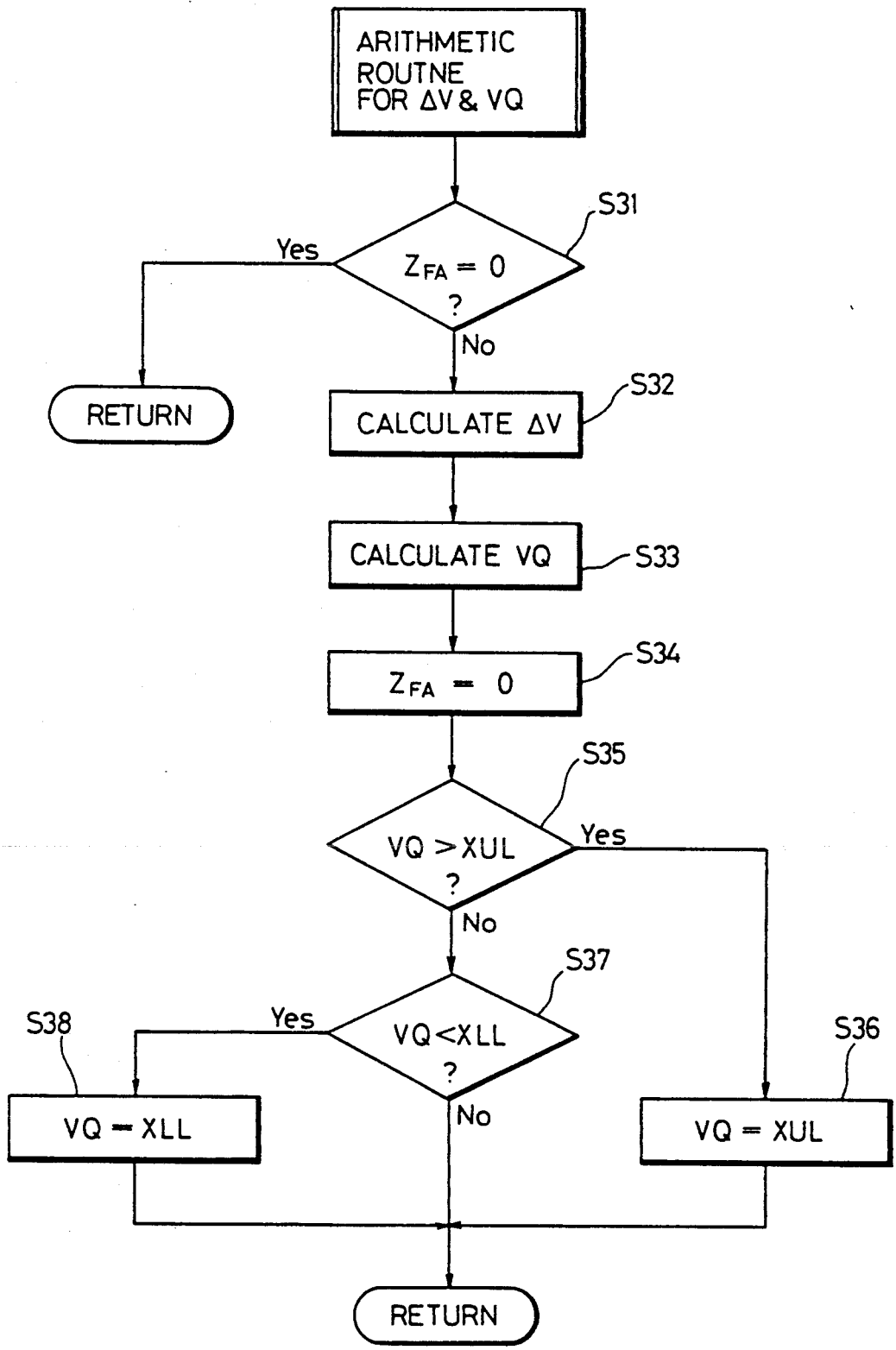
FIG. 6 is a flow chart showing steps of procedure for obtaining a deviation $\Delta V$ and a deviation integral VQ in executing the feedback control.

FIG. 6 shows the details of the arithmetic routine of Step S30. In Step S31, the ECU 44 first determines whether a variable $Z_{FA}$ is 0. The variable $Z_{FA}$, which is already obtained in the first interruption routine (mentioned later), is a value proportional to the generating frequency of Kalman vortexes detected by means of the airflow sensor 50.

Figure 7:
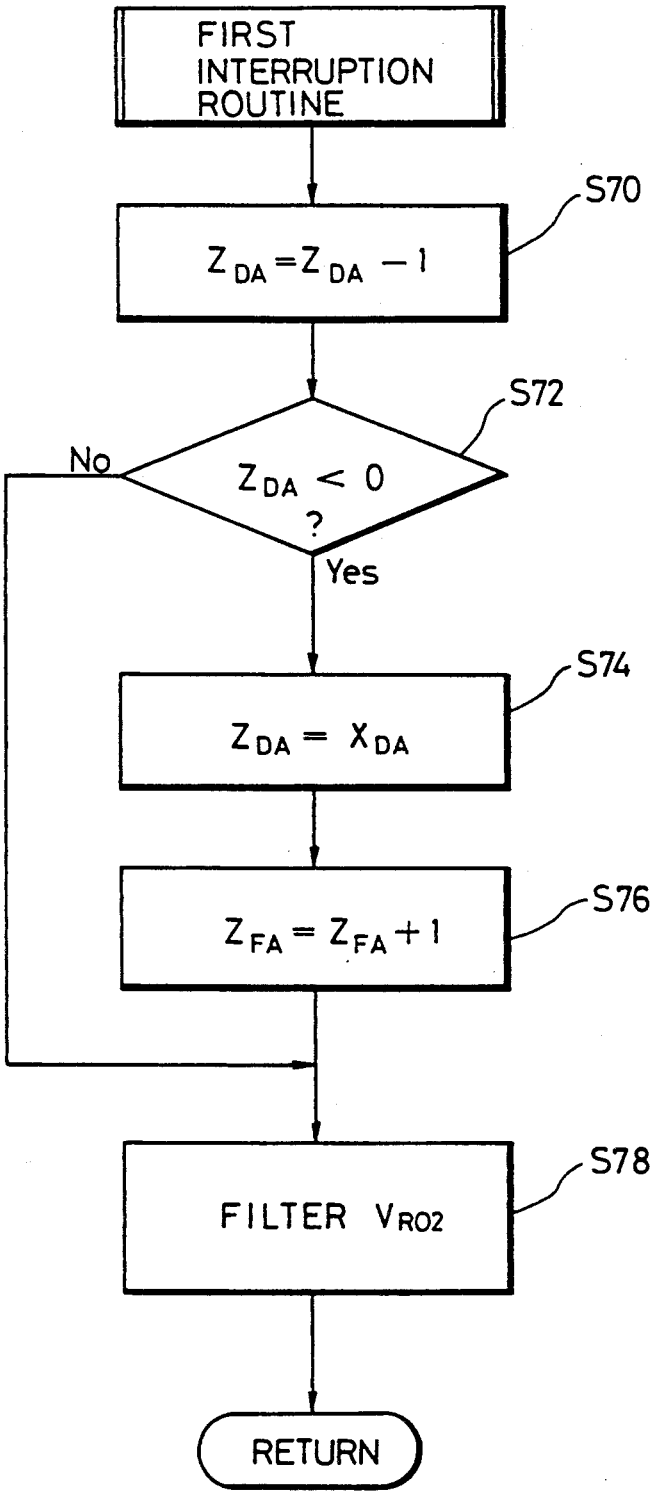
FIG. 7 is a flow chart showing a first interruption routine for the execution of the feedback control.

Referring now to FIG. 7, the first interruption routine will be described. The first interruption routine is executed with first priority every time the production of thr Kalman vortex is detected by the airflow sensor 50.

As is evident from the above description, Steps S70 to S76 are steps in which the deviation $\Delta V$, the deviation integral VQ, and the variable $Z_{FA}$ used eventually to calculate the fifth correction factor $K_{BC}$. The variable $Z_{FA}$ has a value corresponding to the amount of airflow detected by means of the airflow sensor 13. Step S78 is a step for filtering the output voltage $V_{RO2}$ of the rear $O_2$ sensor 42.

First, in Step S70, the value of a frequency-dividing variable $Z_{DA}$ is decremented by one every time the first interruption routine is executed. Then, in Step S72, whether the variable $Z_{DA}$ is smaller than 0 is determined. If the variable $Z_{DA}$ is not smaller than 0, the program proceeds directly to Step S78. If the variable $Z_{DA}$ is smaller than 0, an initial value $X_{DA}$ is substituted for the value of the variable $Z_{DA}$ in Step S74, and the value of the variable $Z_{FA}$ is then incremented by one in Step S76. Thus, the value of the variable $Z_{FA}$ is reset or incremented by one every time the airflow sensor 50 detects a predetermined number ($X_{DA}$) of Kalman vortexes.

Then, in Step S78, the output voltage (instantaneous value) $V_{RO2}$ of the receiving circuit 45 itself is filtered as follows:

$$V_{R02}=V_{R02}+(V_R-V_{R02})/X_{TQ} \quad (2)$$

Figure 3:
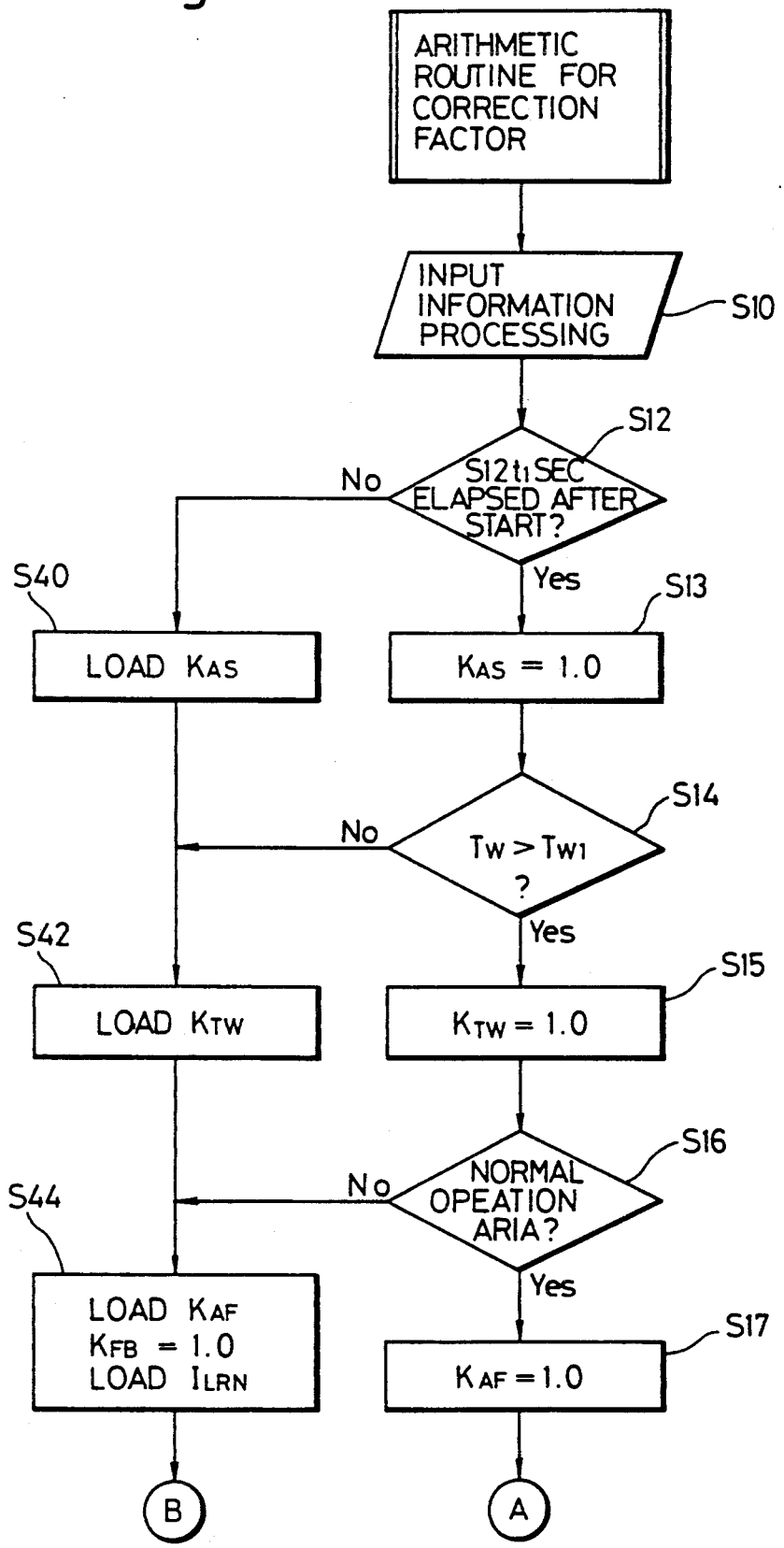
FIGS. 3 to 5 are flow charts showing steps of procedure for obtaining a correction factor in executing feedback control.

More specifically, the newly filtered output voltage $V_{R02}$ can be obtained by calculating the difference between the value of the instantaneous output voltage $V_R$ of the rear $O_2$ sensor 42 (fetched with the lapse of every predetermined time (e.g., 10 msec) in Step S10 of FIG. 3 and resulting after A/D conversion), obtained during the execution of the first interruption routine, and the value of the output voltage $V_{R02}$ obtained by the preceding filtering, and adding part of this difference to the value of the previously obtained output voltage $V_{R02}$. $X_{TQ}$ is a constant which is equivalent to a time constant. Thus, if the value of the instantaneous output voltage $V_{R02}$ of the rear $O_2$ sensor 42 or the receiving circuit 45 is filtered according to the first interruption routine, the time constant is fixed with respect to the amount of intake air, so that the filtering process can favorably be effected in association with the intake air amount.

If it is concluded in Step S31 of FIG. 6 that the variable $Z_{FA}$ is 0 when the intake air amount is very small, that is, if the decision in Step S31 is YES, no operation is executed for the deviation $\Delta V$ and the deviation integral VQ, and the routine of FIG. 6 is finished with these values kept as they are.

If the decision in Step S31 is NO, the program proceeds to Step S32. In Step S32, the deviation $\Delta V$ is calculated as follows:

$$\Delta V=V_{XR}-V_{R02} \quad (3)$$

where $V_{XR}$ is a reference voltage (target voltage) of the rear $O_2$ sensor 42, and $V_{R02}$ is the value of the output voltage from the sensor 42 after the filtering in the first interruption routine.

Then, in Step S33, the deviation integral VQ is calculated as follows:

$$VQ = VQ + Z_{FA} \times \Delta V \times C \quad (4)$$

As seen from Equation (4), the present deviation integral VQ is obtained by adding the product of the value $Z_{FA}$ corresponding to the present airflow amount, the deviation $\Delta V$, and a constant C as a conversion factor to the present deviation integral VQ. When the calculation of the deviation integral VQ is finished, the variable $Z_{FA}$ is reset to 0 in Step S34.

Then, in Steps S35 to S38, whether the value of the deviation integral VQ is intermediate between its upper- and lower-limit values is checked. In Step S35, the deviation integral VQ and the upper-limit value XUL are compared. If the deviation integral VQ is greater than the upper-limit value XUL, it is set to the value XUL in Step S36. If the decision in Step S35 is NO, on the other hand, the program proceeds to Step S37. In Step S37, the deviation integral VQ and the lower-limit value XLL are compared. If the deviation integral VQ is smaller than the lower-limit value XLL, it is set to the value XLL in Step S38.

The up-to-date value of the deviation integral VQ may be kept stored in the nonvolatile memory even after the engine 12 is stopped, so that it can be used in a new cycle of engine operation.

When the calculation of the deviation $\Delta V$ and the deviation integral VQ is finished in this manner, the program proceeds to Step S50 of FIG. 5. Using the values $\Delta V$ and VQ, in Step S50, the fifth correction factor $K_{BC}$ is calculated according to the following equation.

$$K_{BC} = 1.0 + G_p \times \Delta V + G_I \times VQ \quad (5)$$

where $G_P$ and $G_I$ are a proportional gain and an integral gain, respectively, which are set to their respective predetermined values.

In Steps S52 to S58, whether the value of the fifth correction factor $K_{BC}$ obtained according to Equation (5) is intermediate between its upper- and lower-limit values is checked. In Step S52, the value of the fifth correction factor $K_{BC}$ and the upper-limit value $X_{BCU}$ are compared. If the value of the fifth correction factor $K_{BC}$ is greater than the upper-limit value $X_{BCU}$, it is set to the value $X_{BCU}$ in Step S54. If the value of the fifth correction factor $K_{BC}$ is found to be smaller than the lower-limit value $X_{BCL}$ in Step S56, on the other hand, it is set to the value $X_{BCL}$. The fifth correction factor $K_{BC}$ obtained in this manner is stored in the aforesaid memory.

Then, in Step S59, a correction factor K is calculated according to the following equation, using the other correction factors than the fourth and fifth factors $K_{FB}$ and $K_{BC}$.

$$K = K_{AS} \times K_{TW} \times K_{AF} \times K_{OT} \times \ldots \quad (6)$$

where $K_{AS}$, $K_{TW}$, and $K_{AF}$ are the first, second, and third correction factors, respectively, and $K_{OT}$ indicates other correction factors. The factors $K_{OT}$ include correction factors for the intake air temperature, atmospheric pressure, acceleration and deceleration of the automobile, etc. After causing the calculated correction factor K to be stored in the memory, the ECU 44 finishes the execution of the arithmetic routine for the correction factor.

Figure 8:
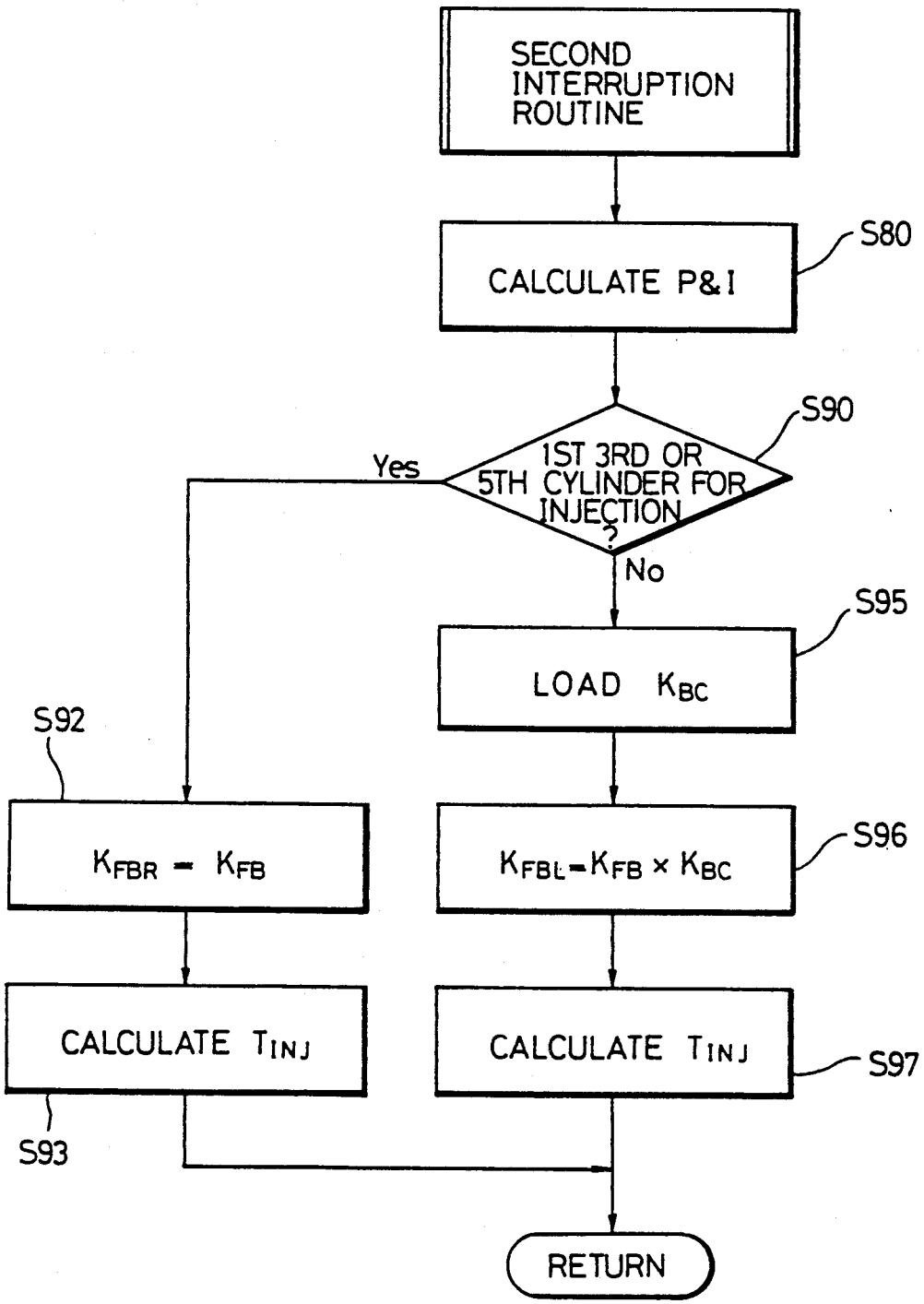
FIG. 8 is a flow chart showing a second interruption routine for the execution of the feedback control.

The program flow chart of FIG. 8 shows the second interruption routine. When the predetermined crank-angle position of each cylinder is detected by means of the crank angle sensor 56, the ECU 44 executes this interruption routine. First, in Step S80, an arithmetic routine for the values P and I, used to calculate the fourth correction factor $K_{FB}$, is executed.

Figure 9:
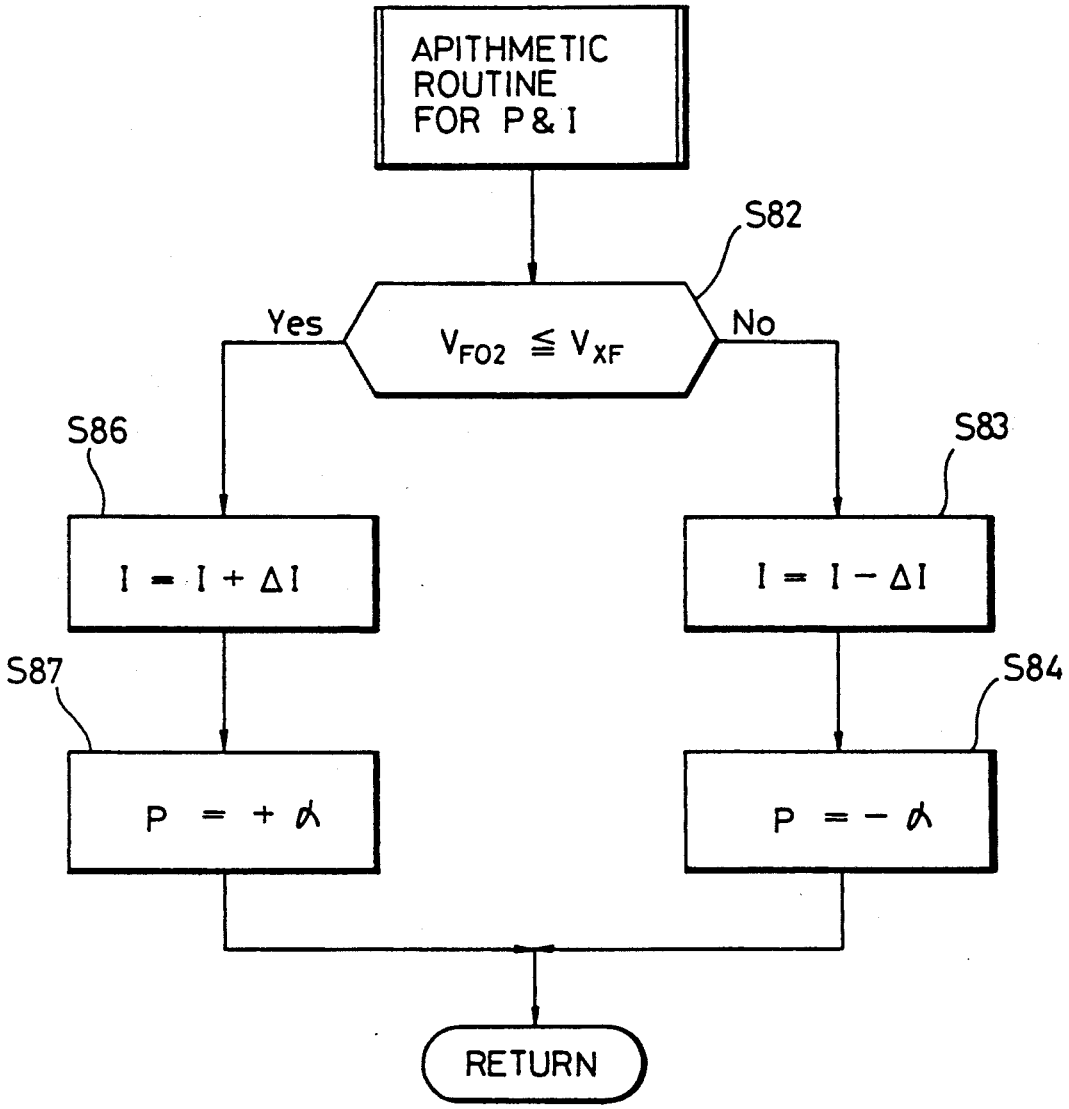
FIG. 9 is a flow chart showing the details of one step of the second interruption routine.

FIG. 9 shows the arithmetic routine for the values P and I. In Step S82, whether the output voltage $V_{FO2}$ of the front $O_2$ sensor 40 is lower than the reference value $V_{XF}$ is determined. If the decision in Step S82 is NO, that is, if the output voltage $V_{FO2}$ is higher than the reference value $V_{XF}$ so that the oxygen concentration of the exhaust gas discharged into the right-bank-side exhaust manifold 30 takes a value such that the air-fuel ratio is on the rich side, the integral term value I and the proportional term value P are calculated in Steps S83 and S84, respectively, according to the following equations.

$$I = I - \Delta I \quad (7)$$

$$P = -\alpha \quad (8)$$

Thus, the integral term value I is updated by subtracting a predetermined value $\Delta I$ from the preceding value, and the proportional term value P is set to a predetermined negative value $(-\alpha)$.

If the decision in Step S82 is YES, that is, if the output voltage $V_{FO2}$ of the front $O_2$ sensor 40 is lower than the reference value $V_{XF}$ so that the oxygen concentration of the exhaust gas takes a value such that the air-fuel ratio is on the lean side, the integral term value I and the proportional term value P are calculated in Steps S86 and S87, respectively, according to the following equations.

$$I = I + \Delta I \quad (9)$$

$$P = +\alpha \quad (10)$$

Thus, the integral term value I is updated by adding the predetermined value $\Delta I$ to the preceding value, and the proportional term value P is set to a predetermined positive value $(+\alpha)$.

The integral term value I and the proportional term value P, obtained in this manner, are stored in the memory, whereupon the program proceeds to Step S90 of FIG. 8.

In Step S90, whether the TDC signal inputted this time corresponds to the right bank 12*a* or the left bank 12*b*, that is, whether the cylinder into which the fuel is to be injected this time is any of the first, third, and fifth cylinders is determined. If the decision in Step S90 is YES, the fuel must be injected into any of the cylinders of the right bank 12*a*, so that the program proceeds to Step S92. In Step S92, a correction factor $K_{FBR}$ for the right bank is calculated according to the following equation.

$$K_{FBR} = K_{FB} \quad (11)$$

where $K_{FB}$ is the fourth correction factor which is already obtained and stored in Step S20 shown in FIG. 4.

Then, in Step S93, the ECU 44 calculates the valve-opening period $T_{INJ}$ according to the following equation, using the correction factor $K_{FBR}$.

$$T_{INJ}=T_B\times K_{FBR}\times K+T_D \quad (12)$$

where $T_B$ is a basic valve-opening period, which is read out from a prestored table in accordance with the engine speed Ne and the intake air amount A/N, for example. K is the correction factor obtained in Step S59 of FIG. 5, and $T_D$ is a correction value set in accordance with the battery voltage or the like.

The ECU 44 supplies the driving signal corresponding to the valve-opening period $T_{INJ}$ to the fuel injection valve 16 of the cylinder of the right bank 12*a* into which the fuel is to be injected this time. As a result, the valve 16 is opened, thus allowing an amount of fuel corresponding to the valve-opening period $T_{INJ}$ to be supplied to the corresponding cylinder.

If the decision in Step S90 is NO, on the other hand, the fuel must be injected into any of the cylinders of the left bank 12*b*, so that the program proceeds to Step S95. In Step S95, the fifth correction factor $K_{BC}$ is read out from the aforesaid memory. Then, in Step S96, a correction factor $K_{FBL}$ for the left bank is calculated according to the following equation.

$$K_{FBL}=K_{FB}\times K_{BC} \quad (13)$$

where $K_{FB}$ is the fourth correction factor which is already obtained and stored in Step S20 shown in FIG. 4.

Then, in Step S97, the ECU 44 calculates the valve-opening period $T_{INJ}$ according to the following equation, using the correction factor $K_{FBL}$.

$$T_{INJ}=T_B\times K_{FBL}\times K+T_D \quad (14)$$

where $T_B$, K, and $T_D$ are the same as the ones used in Equation (12).

Thereafter, the ECU 44 supplies the driving signal corresponding to the valve-opening period $T_{INJ}$ to the fuel injection valve 16 of the cylinder of the left bank 12*b* into which the fuel is to be injected this time. As a result, the valve 16 is opened, thus allowing an amount of fuel corresponding to the valve-opening period $T_{INJ}$ to be supplied to the cylinder concerned.

The valve-opening period $T_{INJ}$ may be calculated by various other manners than the manner of the embodiment described above. The system is expected only to first determine the amount of fuel supply to each cylinder in accordance with the output of the front $O_2$ sensor 40, and then control the amount of fuel supply to the cylinders of the other bank, compared to the amount of fuel supply to the cylinders of the bank on the side of the sensor 40, in accordance with the output of the rear $O_2$ sensor 42.

In the embodiment described above, moreover, the fuel injection valve 16 of the so-called multipoint injection type (MIP type) is used as a fuel supply unit which is located in the vicinity of the inlet port of each cylinder. However, the present invention is not limited to this arrangement, and only one fuel injection valve may be provided in common for the individual cylinders of each bank so that the fuel is injected alternately for the banks (simultaneous injection in each bank). In this case, the bank for the fuel injection can be identified by detecting the rotational phase of a rotor of the distributor, which rotates at half the angular speed of the crankshaft, for each 120° by means of the cylinder discriminating sensor 58.

If the present invention is applied to an engine of a type such that the fuel is simultaneously injected in each bank, the fuel injection valve, for use as the fuel supply unit, may be replaced with an electronically-controlled carburetor or the like, which controls the amount of fuel supply by adjusting the amount of bleed air.

The front and rear $O_2$ sensors 40 and 42 may be the so-called λ-type oxygen sensors or linear type oxygen sensors. Further, the rear $O_2$ sensor 42, in the common exhaust gas pipe 34, may be located on the lower-course side of the catalytic converter 36.

Figure 10:
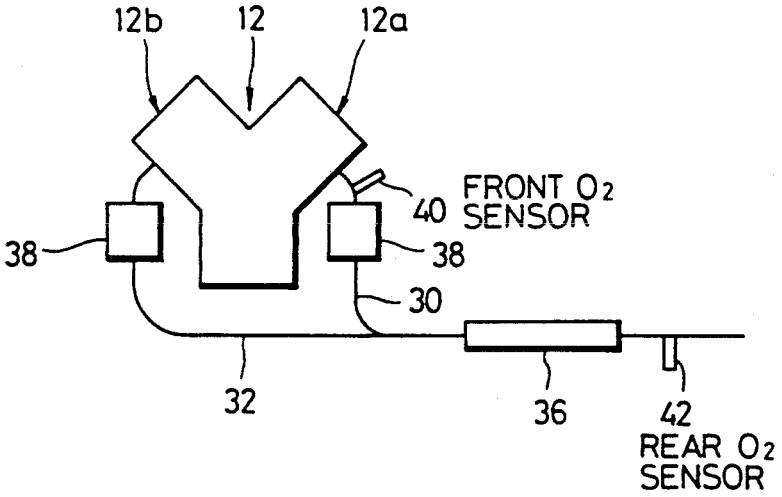
FIGS. 10 to 12 show modifications of the internal combustion engine to which the system of the present invention is applied.
Figure 11:
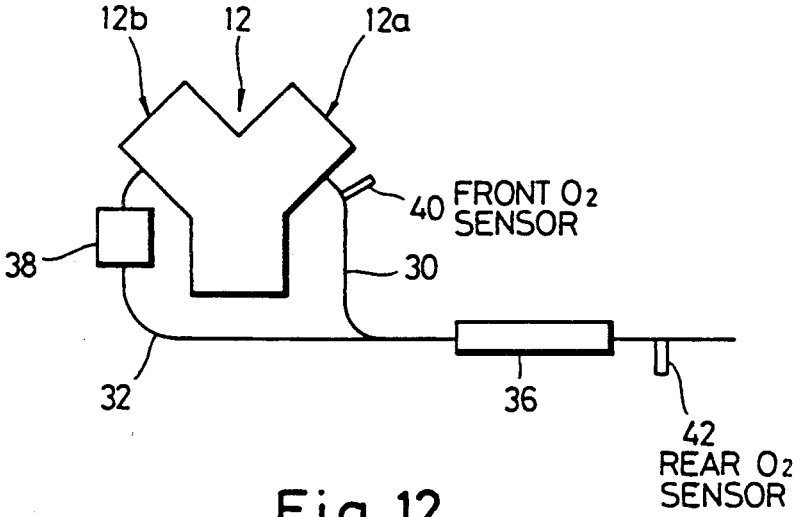
Figure 12:
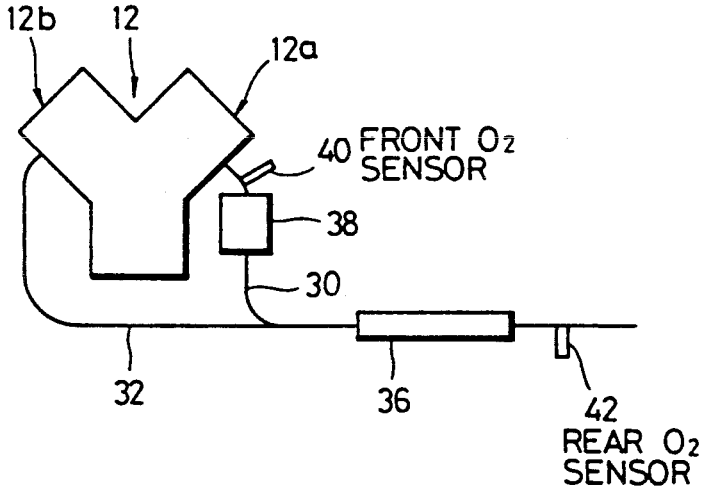

Furthermore, the present invention may be applied to an engine in which a catalytic converter 38 for warm-up may be attached to each or one of the right- and left-bank-side exhaust manifolds 30 and 32, as shown in FIGS. 10 to 12. If the front $O_2$ sensor 40 is disposed in the same exhaust passage with the converter 38, in this case, it is preferably located on the upper-course side of the converter 38. In FIGS. 10 to 12, like reference numerals refer to the same components as are shown in FIG. 1.

In the embodiment described above, moreover, the present invention is applied to the V-6 engine. It is to be understood, however, that the invention may be also applied, for example, to a straight-type 4-cylinder engine which has independent exhaust passages for individual groups of cylinders, in order to avoid exhaust interference. Also in this case, it is necessary only that the front $O_2$ sensor be attached to one of the exhaust passages. Thus, the degree of freedom of the layout of the front $O_2$ sensor is high, and the mounting position of the front $O_2$ sensor can be determined without regard to the other exhaust passage.

What is claimed is:

1. A system for feedback-controlling the air-fuel ratio of an air-fuel mixture to be supplied to an internal combustion engine so that the air-fuel ratio is equal to a target air-fuel ratio, said internal combustion engine including a plurality of cylinders classified into first and second groups, first and second exhaust pipes for guiding exhaust gas from the cylinders of the internal combustion engine which are connected to the corresponding exhaust pipe, a common exhaust pipe connected with both the first and second exhaust pipes, a catalyst-type exhaust gas disposer located in the common exhaust pipe and used to purify the exhaust gas from the internal combustion engine guided through the first and second exhaust pipes, and first and second fuel supply means assigned to the first and second groups of cylinders, respectively, and adapted to supply a fuel independently to the cylinders of the corresponding groups, said system comprising:

first detecting means for detecting the oxygen concentration of the exhaust gas flowing through the first exhaust pipe;

second detecting means for detecting the oxygen concentration of the exhaust gas after being purified by means of the exhaust gas disposer;

decision means for determining the amount of fuel to be supplied from the first and second fuel supply means to the first and second groups of cylinders, in accordance with the oxygen concentration of the exhaust gas detected by the first detecting means; and correction means for correcting the amount of fuel to be supplied from the second fuel supply means determined by the decision means, in accordance with the oxygen concentration of the exhaust gas detected by the second detecting means.

2. A system according to claim 1, which further comprises first discrimination means for determining whether the operating condition of the internal combustion engine is within a first operation area in which the amount of fuel supply is to be feedback-controlled by means of the decision means, and second discrimination means for determining whether the operating condition of the internal combustion engine is within a second operation area in which the amount of fuel supply is to be feedback-controlled by means of the correction means, said second operation area being included in the first operation area, and wherein said correction means operates when the first and second discrimination means conclude that the operating condition of the internal combustion engine is within the second operation area.

3. A system according to claim 2, wherein said second discrimination means concludes that the operating condition of the internal combustion engine is within the second operation area when any of the requirements:

(a) that the cumulative amount of intake air of the internal combustion engine should not be less than a predetermined value Q1;

(b) that the cumulative amount of intake air of the internal combustion engine should not be less than a predetermined value Q2 after the fuel supply to the engine is stopped; and (c) that the amount of intake air of the internal combustion engine per unit time should not be less than a predetermined value F1, after the operating state of the internal combustion engine attains the first operation area.

4. A system according to claim 1, wherein said second detecting means includes sensor means for delivering an output corresponding to the oxygen concentration of the exhaust gas, and filter means for filtering the output from the sensor means and then delivering a filtered output, and said correction means includes difference generating means for obtaining the difference between the filtered output and a reference value equivalent to the target air-fuel ratio and delivering an output corresponding to the difference, whereby said correction means corrects the amount of fuel supply from the second fuel supply means in accordance with the output from the difference generating means.

5. A system according to claim 4, wherein said second detecting means further includes sampling means for sampling the output $V_R$ of the sensor means every time the cumulative amount of intake air of the internal combustion engine attains a predetermined value, and said filter means obtains the filtered output $V_{RO2}$ every time the output $V_R$ is obtained by means of the sampling means, in accordance with an equation expressed as follows:

$$V_{RO2}=V_{RO2old}+(V_R-V_{RO2old})/X_{TQ},$$

where $V_{RO2old}$ is the filtered output obtained by filtering the output $V_R$ for the preceding sampling, and $X_{TQ}$ is a constant ($X_{TQ}>1$).

6. A system according to claim 1, wherein said second detecting means includes sensor means for delivering an output corresponding to the oxygen concentration of the exhaust gas, and cumulative means for cumulatively obtaining the difference between the output of the sensor means and a reference value equivalent to the target air-fuel ratio and delivering an output corresponding to the resulting cumulative value, and said correction means corrects the amount of fuel supply from the second fuel supply means in accordance with the output of the cumulative means.

7. A system according to claim 6, which further comprises means for obtaining correction data for the amount of fuel supply in accordance with the output of the cumulative means and information corresponding to the amount of intake air of the internal combustion engine, whereby said correction means corrects the amount of fuel supply from the second fuel supply means in accordance with the correction data.

8. A system according to claim 6, wherein said second detecting means includes a sensor for detecting the oxygen concentration of the exhaust gas, said sensor being capable of detecting the oxygen concentration of the exhaust gas when in an active state, and incapable of detecting the oxygen concentration of the exhaust gas when in an inactive state, and said system further comprises third detecting means for detecting the inactive state of the sensor and memory means for storing the output of the cumulative means, and wherein said correction means includes receiving means for receiving the output of the cumulative means stored in the memory means, and said cumulative means includes means for interrupting the renewal of the cumulative value when the inactive state of the sensor is detected by the third detecting means.

9. A system according to claim 6, which further comprises third detecting means for detecting a failure of the second detecting means and memory means for storing the output of the cumulative means, and wherein said correction means includes receiving means for receiving the output of the cumulative means stored in the memory means, and which further comprises means for resetting the value stored in the memory means and corresponding to the output of the cumulative means to a value having no effect on the feedback control of the air-fuel ratio when the failure of the second detecting means is detected by the third detecting means.

10. A system according to claim 6, wherein said correction means includes difference means for obtaining the difference between the output of the sensor means and the reference value equivalent to the target air-fuel ratio, whereby said correction means corrects the amount of fuel supply from the second fuel supply means in accordance with said difference.

11. A system according to claim 10, wherein said second detecting means includes a sensor for detecting the oxygen concentration of the exhaust gas, said sensor being capable of detecting the oxygen concentration of the exhaust gas when in an active state, and incapable of detecting the oxygen concentration of the exhaust gas when in an inactive state, and said system further comprises third detecting means for detecting the inactive state of the sensor and memory means for storing the output of the cumulative means, and wherein said correction means includes receiving means for receiving the output of the cumulative means stored in the memory means, said cumulative means includes means for interrupting the renewal of the cumulative value when the inactive state of the sensor is detected by the third detecting means, and said correction means corrects the amount of fuel supply from the second fuel supply means in accordance with the output of the cumulative means stored in the memory means, without regard to the value of the difference obtained by means of the difference means, when the inactive state of the sensor is detected by the third detecting means.

12. A system according to claim 10, which further comprises third detecting means for detecting a failure of the second detecting means, and stop means for stopping the operation of the correction means when the failure of the second detecting means is detected by the third detecting means.

13. A system according to claim 1, wherein said second detecting means includes an oxygen sensor of the concentration-cell type, having a characteristic such that the internal resistance of the oxygen sensor is small when the sensor is active and is great when the sensor is inactive, said oxygen sensor having an output terminal at which an output voltage corresponding to the oxygen concentration of the exhaust gas is obtained, and a bias circuit for applying a bias voltage to the output terminal of the oxygen sensor, said bias circuit including a reference resistor connected to the output terminal of the oxygen sensor, the resistance of said reference resistor assuming a value smaller enough than the internal resistance obtained when the oxygen sensor is inactive and greater enough than the internal resistance obtained when the oxygen sensor is active, said bias voltage being set to a value intermediate between the maximum and minimum output voltages of the oxygen sensor; and said correction means corrects the amount of fuel supply from the second fuel supply means in accordance with the output voltage of the oxygen sensor obtained when the bias voltage is applied to the sensor.

14. A system according to claim 13, which further comprises means for setting the upper and lower-limit values of the output voltage of the oxygen sensor, and stop means for stopping the operation of the correction means when the output voltage of the oxygen sensor attains the upper-or lower-limit value.

15. A system according to claim 13, which further comprises difference means for obtaining the difference between the output voltage of the oxygen sensor and the bias voltage or a reference value in the vicinity of the bias voltage, cumulative means for accumulating the difference obtained by means of the difference means, thereby obtaining a cumulative value, and memory means for storing the cumulative value obtained by means of the cumulative means, and wherein said correction means corrects the amount of fuel supply from the second fuel supply means in accordance with the cumulative value stored in the memory means, and said system further comprises means for interrupting the renewal of the cumulative value by the cumulative means when the difference obtained by means of the difference means takes a value in the vicinity of zero.

16. A system according to claim 15, wherein said correction means corrects the amount of fuel supply from the second fuel supply means in accordance with the difference obtained by means of the difference means, and is adapted to correct the amount of fuel supply from the second fuel supply means in accordance with the cumulative value stored in the memory means, without regard to the difference obtained by means of the difference means, when said difference takes a value in the vicinity of zero.

17. A system according to claim 1, which further comprises a second catalyst-type exhaust gas disposer located at least in one of the first and second exhaust pipes.

18. A system according to claim 17, wherein said second exhaust gas disposer is located in the first exhaust pipe, and said first detecting means detects the oxygen concentration of the exhaust gas before the exhaust gas passes through the second exhaust gas disposer.

* * * * *